US009307819B1

(12) United States Patent
Schern

(10) Patent No.: US 9,307,819 B1
(45) Date of Patent: Apr. 12, 2016

(54) DUAL OPENING SYSTEM FOR A BAG

(71) Applicant: Gura Gear, LLC, Ogden, UT (US)

(72) Inventor: Gregory Schern, Ogden, UT (US)

(73) Assignee: GuraGear, LLC, Ogden, UT (US)

( * ) Notice: Subject to any disclaimer, the term of this patent is extended or adjusted under 35 U.S.C. 154(b) by 0 days.

(21) Appl. No.: 14/019,378

(22) Filed: Sep. 5, 2013

Related U.S. Application Data

(60) Provisional application No. 61/697,212, filed on Sep. 5, 2012.

(51) Int. Cl.
*A45C 11/38* (2006.01)

(52) U.S. Cl.
CPC ..... *A45C 11/38* (2013.01)

(58) Field of Classification Search
CPC ..... B65D 31/12; B65D 81/3261; B65D 33/2566; B65D 33/004; B65D 29/00; A45C 3/00; A45C 13/02; A45C 13/42; A45C 7/0077; A45C 11/20; A45C 5/06
USPC ..... 383/38, 40; 190/107, 110, 113, 115
See application file for complete search history.

(56) References Cited

U.S. PATENT DOCUMENTS

| | | | | | |
|---|---|---|---|---|---|
| 4,506,769 | A * | 3/1985 | Franco et al. | 190/108 |
| 4,693,344 | A * | 9/1987 | Shuler | 190/107 |
| 5,505,307 | A * | 4/1996 | Shink | 206/541 |
| 5,896,962 | A * | 4/1999 | Smith et al. | 190/107 |
| 6,234,677 | B1 * | 5/2001 | Mogil | 383/110 |
| 6,409,066 | B1 * | 6/2002 | Schneider et al. | 224/585 |
| 7,665,421 | B2 * | 2/2010 | Martz | 119/497 |
| 7,815,024 | B1 * | 10/2010 | Quimpo et al. | 190/107 |
| 2002/0126920 | A1 * | 9/2002 | Mogil | 383/110 |
| 2002/0148741 | A1 * | 10/2002 | Stobbs et al. | 206/112 |
| 2004/0008907 | A1 * | 1/2004 | Bartlett et al. | 383/7 |
| 2007/0237432 | A1 * | 10/2007 | Mogil | 383/38 |
| 2008/0135364 | A1 * | 6/2008 | Chang et al. | 190/103 |
| 2008/0142558 | A1 * | 6/2008 | Dexter | 224/275 |
| 2009/0052809 | A1 * | 2/2009 | Sampson | 383/38 |

* cited by examiner

*Primary Examiner* — J. Gregory Pickett
*Assistant Examiner* — Peter Helvey
(74) *Attorney, Agent, or Firm* — Clayton, Howarth & Cannon, P.C.

(57) ABSTRACT

A dual opening system for a bag is provided. The system includes a flap operatively coupled to a bag, the bag having and inner volume, a releasable hinge extending the length of the flap, and a bottom hinge coupled between a bottom portion of the flap and a bottom portion of the bag. The system also includes a connecting device having a first member coupled to a top portion of the flap and a second member coupled to a top portion of the bag, wherein the first member and second member are moveable between an engaged position and disengaged position. The system also includes an opening device allowing the flap to open in a first opening type and a second opening type.

23 Claims, 2 Drawing Sheets

DUAL OPENING SYSTEM FOR A BAG

CROSS REFERENCE TO RELATED APPLICATION[S]

This claims priority to U.S. Provisional Patent Application entitled "DUAL OPENING SYSTEM FOR A BAG," Ser. No. 61/697,212, filed Sep. 5, 2012, the disclosure of which is hereby incorporated entirely herein by reference.

BACKGROUND OF THE INVENTION

1. Technical Field

This invention relates generally to a system for opening a bag and more particularly to a dual opening system for a bag.

2. State of the Art

Bags are used for carrying of any type of goods, such as books, clothing, computers and cameras. Often, these bags need to be accessed in order to remove the goods. Further, some bags are sectioned, wherein there are defined areas that hold certain types of goods or equipment. For example, and without limitation, a camera bag may be compartmentalized, wherein one compartment holds the camera, another compartment holds a tripod, and another compartment holds an accessory lens.

Conventional bags have a single opening to access the inner portion of the bag and expose the inner compartments. In order to use a conventional camera bag, a user must put the bag on a substantially flat surface and then open the single flap to obtain access to the compartments. The user may then access the goods and utilize them.

Conventional bags lack the ability to have a dual opening in the flap to access only part of the compartments within the bag, while keeping the remainder of the goods covered.

Accordingly, there is a need in the field of camera bags for an improved bag with a dual system for opening the bag.

DISCLOSURE OF THE INVENTION

The present invention relates to a dual opening system for a bag, wherein the system includes a flap allowing for dual types of openings, wherein one type of opening exposes only a portion of the interior of the bag and the second type of opening exposes the entire interior of the bag.

An embodiment of the present invention includes a dual opening system for a bag. The system comprises a flap operatively coupled to a bag, the bag having and inner volume. The system also includes a releasable hinge extending the length of the flap, wherein the releasable hinge is located substantially along a fold line of the flap. The system further includes a bottom hinge coupled between a bottom portion of the flap and a bottom portion of the bag. Additionally, the system includes a connecting device having a first member coupled to a top portion of the flap and a second member coupled to a top portion of the bag, wherein the first member and second member are moveable between an engaged position and disengaged position, and an opening device allowing the flap to open in a first opening type and a second opening type.

The first opening type comprises the connecting device in the engaged position to allow the opening device to be disengaged on one side of the flap between the bottom hinge and the connecting device to open the flap about the releasable hinge.

The second type of opening comprises the connecting device in the disengaged position wherein the opening device is disengaged around the perimeter of the flap to open the flap about the bottom hinge.

Another embodiment includes a dual opening system for a bag. The system comprises a flap operatively coupled to a bag, the bag having and inner volume; an internal divider coupled to the bag in the inner volume, wherein the internal divider extends along a fold line of the flap; and a releasable hinge comprising a first hinge portion and a second hinge portion. The first hinge portion and the second hinge portion are moveable between an engaged and a disengaged position. The first hinge portion is coupled to the flap along the fold line of the flap and the second hinge portion is coupled to internal divider along the length of the internal divider. The system also includes a bottom hinge coupled between a bottom portion of the flap and a bottom portion of the bag, and an opening device allowing the flap to open in a first opening type and a second opening type. The first opening type comprises the opening device disengaged on one side of the flap between the bottom hinge and the fold line of the flap on a top portion of the flap to open the flap about the releasable hinge. The second type of opening comprises the opening device disengaged around the perimeter of the flap to open the flap about the bottom hinge.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a dual opening system for a bag, wherein the system includes a flap allowing for dual types of openings, wherein one type of opening exposes only a portion of the interior of the bag and the second type of opening exposes the entire interior of the bag.

Figure 1:
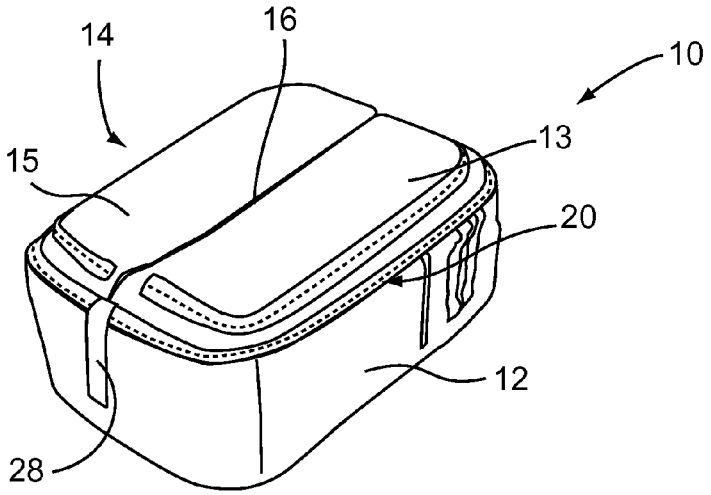
FIG. 1 is a perspective view of a bag with a dual system for opening and closing the bag.
Figure 2B:
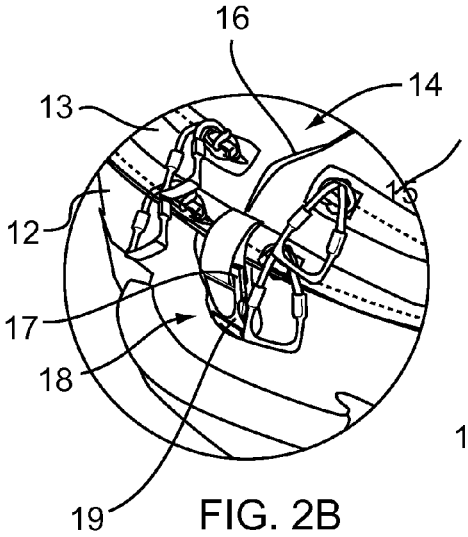
FIG. 2*b* is close-up view of a connecting device of the dual system for opening and closing the bag.
Figure 2A:
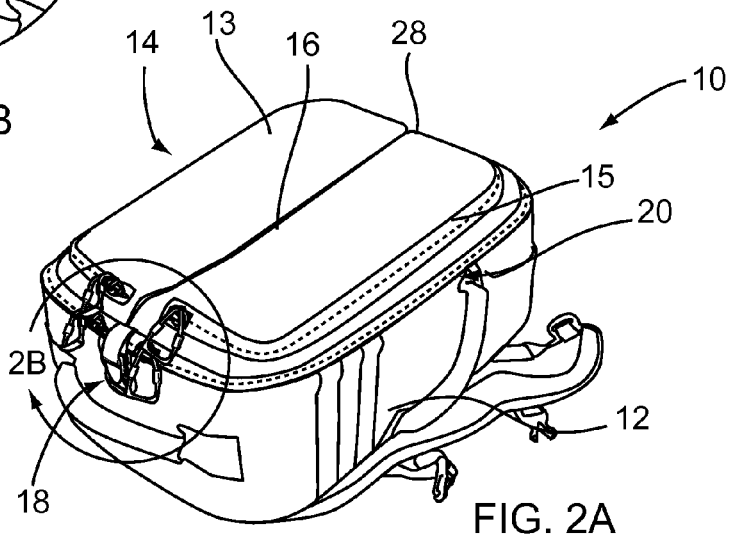
FIG. 2*a* is another perspective view of a bag with a dual system for opening and closing the bag.

Referring to the drawings, FIGS. 1-2*b* depicts an embodiment of a dual opening system 10. The system 10 is coupled to a bag 12. The system 10 comprises a flap 14 having a releasable hinge 16 extending along the length of the flap 14, wherein the releasable hinge 16 is located along a centerline of the flap 14. The releasable hinge 16 separates the flap 14 into a first section 13 and a second section 15. The system 10 further comprises a connecting device 18, an opening device 20 and a bottom hinge 28.

Figure 3:
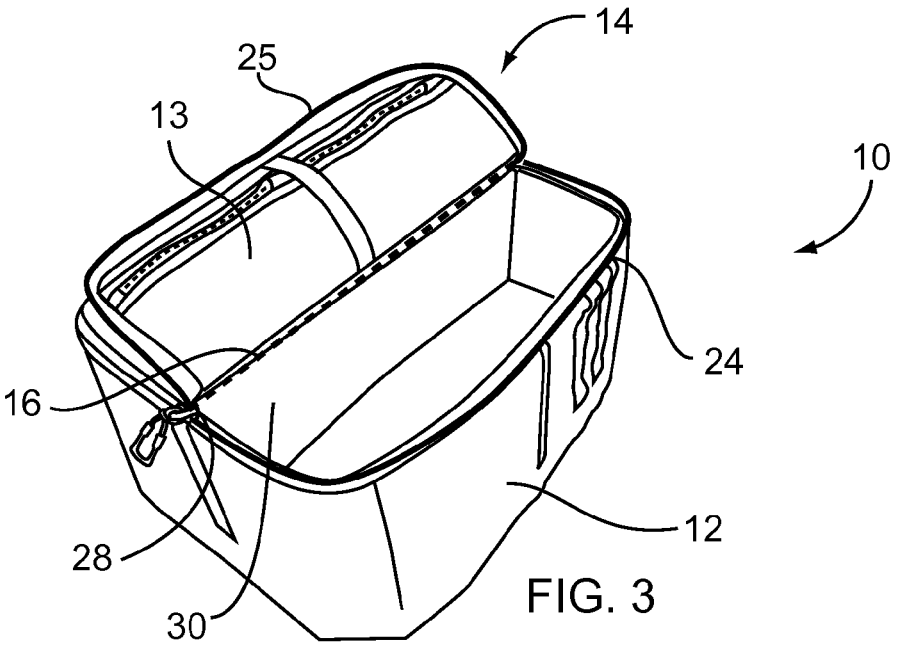
FIG. 3 is a perspective view of a bag with a dual system for opening and closing a bag showing a first opening type.

Referring further to the drawings, FIG. 3 depicts a dual opening system 10 in a first type of opening. In a first type of opening, the connecting device 18 is engaged, wherein the connecting device 18 couples a top portion of the flap 14 to a top portion of the bag 12. The opening device 20 is then disengaged between the bottom hinge 28 and the connecting device 18. With the opening device 20 disengaged, the first section 13 of the flap 14 pivots about the releasable hinge 16 to open. A portion of the interior 26 of the bag 12 is accessible in response to opening the first section 13 in a first type of opening.

As shown in FIG. 3, the opening device 20 may be a zipper having a first zipper portion 24 and a second zipper portion 25. Engaging the opening device 20 may be zipping the zipper portions 24 and 25 together. Disengaging the opening device 20 may include unzipping the zipper portions 24 and 25.

The first type of opening is depicted in the drawings as only opening first portion 13 of the flap 14. It is understood that the same operation can be used to produce a first type of opening with the second portion 15 of the flap 14. The first type of opening allows for a user to access portions of an interior 26 of the bag 12 while keeping the remainder of the interior 26 of the bag 12 covered. Further, according to particular embodiments of the present invention, the first portion 13 and the second portion 15 are not identical in size or shape and in other embodiments, they are.

In some embodiments, the interior of the bag 26 may include an internal divider 30. In these embodiments, the releasable hinge 16 comprises a hook and loop adjustable fastener that releasably couples the releasable hinge 16 along the length of the internal divider 30. In these embodiments, the releasable hinge 16 is held in place, and the flap 14 is secured over another compartment of the bag 12.

Figure 4:
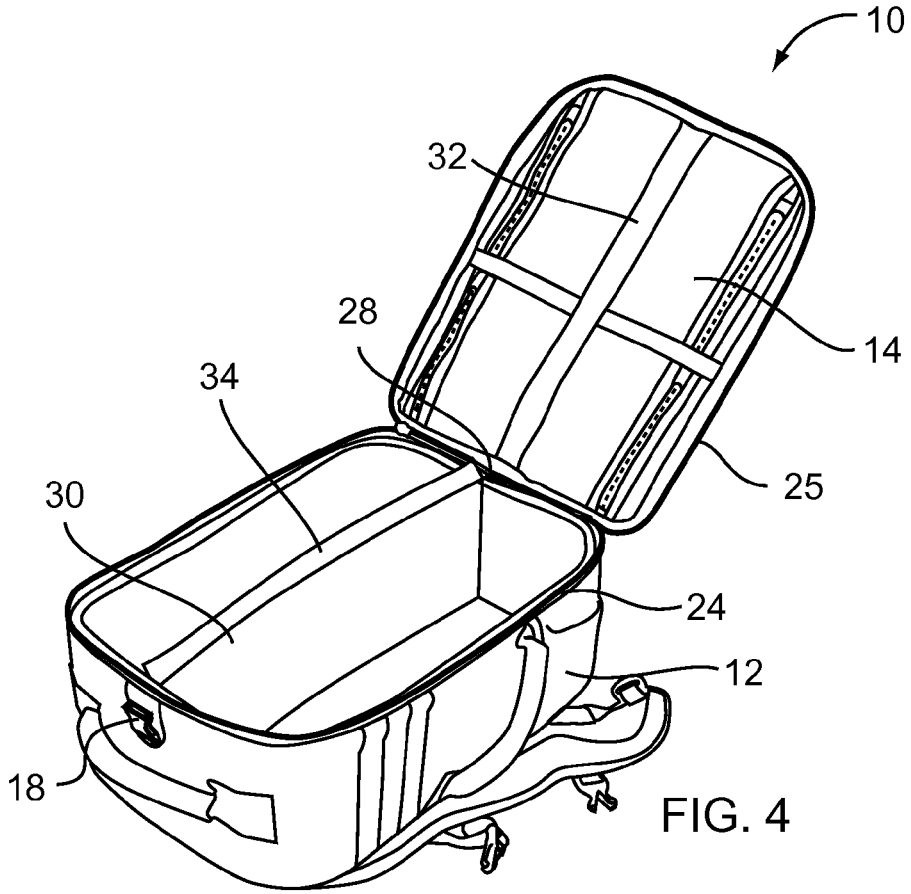
FIG. 4 is a perspective view of a bag with a dual system for opening and closing a bag showing a second opening type.

Referring again to the drawings, FIG. 4 depicts a dual opening system 10 in a second type of opening. In the second type of opening, the connecting device 18 is disengaged. The opening device 20 is disengaged around the perimeter of the flap 14 wherein the flap 14 is coupled to the bag 12 at the bottom hinge 28 allowing the flap 14 to open about the bottom hinge 28 to provide access to an entire interior 26 of the bag 12.

As shown in FIG. 4, the opening device 20 may be a zipper having a first zipper portion 24 and a second zipper portion 25. Engaging the opening device 20 may be zipping the zipper portions 24 and 25 together. Disengaging the opening device 20 may include unzipping the zipper portions 24 and 25.

In some embodiments, the interior of the bag 26 may include an internal divider 30. In these embodiments, the internal divider extends along the fold line of the flap and further extends between the bottom hinge 28 and the connecting device 18. Further, in these embodiments, the releasable hinge 16 comprises a first hinge portion 32 and a second hinge portion 34, wherein the first hinge portion 32 and the second hinge portion 34 are moveable between an engaged and a disengaged position. The first hinge portion 32 is coupled to the flap 14 along the fold line 16 of the flap 14 and the second hinge portion 34 is coupled to the internal divider 30 along the length of the internal divider 30. For clarity purposes, the fold line 16 and the internal divider 30 are configured to communicate with one another in order to allow the releasable hinge 16 to move between the engaged and disengaged positions. In some embodiments, the fold line 16 is a center line and the internal divider 30 is a center divider. Further other configurations are contemplated wherein the fold line 16 and internal divider 30 are substantially linear and not located along a center line of the bag 26.

In some embodiments the releasable hinge 16 comprises a hook and loop adjustable fastener that releasably couples the releasable hinge 16 along the length of the internal divider 30, wherein one of the first or second hinge portions 32 and 34 are a hook member and the other is a loop member so as to allow the first hinge portion 32 to releasably couple to the second hinge portion 34. In FIG. 4, the releasable hinge 16 released from being coupled to the internal divider 30 and the flap 14 is rotatable about the bottom hinge 28 to place the flap 14 in an opened position exposing the entire interior 26 of the bag and providing access to all compartments of the bag.

It will be understood that in some embodiments, the user may elect to have both the first portion 13 and the second portion 15 of the flap 14 in a first type of opening. In this condition, the connecting device 18 is engaged and the opening device on each side is disengaged between the bottom hinge 28 and the connecting device 18. This allows both the first and second portions 13 and 15 of the flap 14 to rotate about the releasable hinge 16. In some embodiments, the releasable hinge 16 is coupled to the internal divider 30 by use of a hook and loop fastener.

According to some embodiments of the present invention, the connecting device 18 is a buckle. In other embodiments, it may any type of connecting device, such as, but not limited to a hook and loop fastener, a strap, a toggle and the like.

Additionally, in some embodiments, the releasable hinge 16 may be reinforced by a rigid member extending along the releasable hinge 16. The rigid member may provide additional structural support to the flap 14 during use of the dual opening system 10.

The components defining any dual opening system for a bag may be formed of any of many different types of materials or combinations thereof that can readily be formed into shaped objects provided that the components selected are consistent with the intended operation of a dual opening system for a bag. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any dual opening system for a bag may be manufactured separately and coupled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A dual opening system for a bag, the system comprising:

a flap operatively coupled to a bag, the bag having and inner volume;

a releasable hinge extending the length of the flap, wherein the releasable hinge is located substantially along a fold line of the flap and wherein the releasable hinge comprises a first hinge portion and a second hinge portion, wherein the first hinge portion and the second hinge portion are moveable between an engaged and a disengaged position;

a bottom hinge coupled between a bottom portion of the flap and a bottom portion of the bag;

a connecting device having a first member coupled to a top portion of the flap and a second member coupled to a top portion of the bag, wherein the first member and second member are moveable between an engaged position and disengaged position; and an opening device allowing the flap to open in a first opening type and a second opening type, wherein:

the first opening type comprises the connecting device in the engaged position to allow the opening device to be disengaged on one side of the flap between the bottom hinge and the connecting device to open the flap about the releasable hinge; and the second type of opening comprises the connecting device in the disengaged position wherein the opening device is disengaged around the perimeter of the flap to open the flap about the bottom hinge.

2. The system of claim 1, further comprising an internal divider coupled to the bag in the inner volume, wherein the internal divider extends between the bottom hinge and the connecting device.

3. The system of claim 1, wherein the first hinge portion is coupled along the fold line of the flap and the second hinge portion is coupled along the internal divider.

4. The system of claim 1, wherein the releasable hinge comprises a hook and loop fastener.

5. The system of claim 1, wherein the connecting device in the engaged position maintains the first hinge portion and the second hinge portion in the engaged position.

6. The system of claim 1, wherein the first hinge portion and the second hinge portion are moveable into the disengaged position when the connecting device is in the disengaged position.

7. The system of claim 1, wherein the connecting device is a buckle.

8. The system of claim 1, wherein the connecting device in the engaged position inhibits the opening device from being disengaged around the perimeter of the flap.

9. A dual opening system for a bag, the system comprising:

a flap operatively coupled to a bag, the bag having and inner volume;

an internal divider coupled to the bag in the inner volume, wherein the internal divider extends along a fold line of the flap;

a releasable hinge comprising a first hinge portion and a second hinge portion, wherein the first hinge portion and the second hinge portion are moveable between an engaged and a disengaged position, and wherein the first hinge portion is coupled to the flap along the fold line of the flap and the second hinge portion is coupled to internal divider along the length of the internal divider;

a bottom hinge coupled between a bottom portion of the flap and a bottom portion of the bag; and an opening device allowing the flap to open in a first opening type and a second opening type, wherein:

the first opening type comprises the opening device disengaged on one side of the flap between the bottom hinge and the fold line of the flap on a top portion of the flap to open the flap about the releasable hinge; and the second type of opening comprises the opening device disengaged around the perimeter of the flap to open the flap about the bottom hinge.

10. The system of claim 9, wherein the releasable hinge comprises a hook and loop fastener.

11. The system of claim 9, further comprising a connecting device having a first member coupled to a top portion of the flap and a second member coupled to a top portion of the bag, wherein the first member and second member are moveable between an engaged position and disengaged position.

12. The system of claim 11, wherein the connecting device in the engaged position maintains the first hinge portion and the second hinge portion in the engaged position.

13. The system of claim 11, wherein the first hinge portion and the second hinge portion are moveable into the disengaged position when the connecting device is in the disengaged position.

14. The system of claim 11 wherein the connecting device is a buckle.

15. The system of claim 11, wherein the connecting device in the engaged position inhibits the opening device from being disengaged around the perimeter of the flap.

16. A dual opening system for a bag, the system comprising:

a flap operatively coupled to a bag, the bag having and inner volume;

a releasable hinge extending the length of the flap, wherein the releasable hinge is located substantially along a fold line of the flap and wherein the releasable hinge comprises a first hinge portion and a second hinge portion, wherein the first hinge portion and the second hinge portion are moveable between an engaged and a disengaged position;

a bottom hinge coupled between a bottom portion of the flap and a bottom portion of the bag;

a connecting device having a first member coupled to a top portion of the flap and a second member coupled to a top portion of the bag, wherein the first member and second member are moveable between an engaged position and disengaged position; and the flap configured to open in a first opening type and a second opening type, wherein:

the first opening type comprises the connecting device in the engaged position to allow the flap to be disengaged between the bottom hinge and the connecting device to open the flap about the releasable hinge; and the second type of opening comprises the connecting device in the disengaged position wherein the flap is configured to open about the bottom hinge.

17. The system of claim 16, further comprising an internal divider coupled to the bag in the inner volume, wherein the internal divider extends between the bottom hinge and the connecting device.

18. The system of claim 16, wherein the first hinge portion is coupled along the fold line of the flap and the second hinge portion is coupled along the internal divider.

19. The system of claim 16, wherein the releasable hinge comprises a hook and loop fastener.

20. A dual opening system for a bag, the system comprising:

a flap operatively coupled to a bag, the bag having and inner volume;

at least one releasable hinge extending in a same direction as a fold line of the flap and wherein the releasable hinge comprises a first hinge portion and a second hinge portion, wherein the first hinge portion and the second hinge portion are moveable between an engaged and a disengaged position;

a bottom hinge coupled between a bottom portion of the flap and a bottom portion of the bag;

a connecting device having a first member coupled to a top portion of the flap and a second member coupled to a top portion of the bag, wherein the first member and second member are moveable between an engaged position and disengaged position; and the flap configured to open in a first opening type and a second opening type, wherein:

the first opening type comprises the connecting device in the engaged position to allow the flap to be disengaged between the bottom hinge and the connecting device to open the flap about the releasable hinge; and the second type of opening comprises the connecting device in the disengaged position wherein the flap is configured to open about the bottom hinge.

21. The system of claim 20, further comprising an internal divider coupled to the bag in the inner volume, wherein the internal divider extends between the bottom hinge and the connecting device.

22. The system of claim 20, wherein the first hinge portion is coupled along the fold line of the flap and the second hinge portion is coupled along the internal divider.

23. The system of claim 20, wherein the releasable hinge comprises a hook and loop fastener.

* * * * *